United States Patent [19]

DeBloois

[11] 4,310,812

[45] Jan. 12, 1982

[54] HIGH POWER ATTENUATOR AND TERMINATION HAVING A PLURALITY OF CASCADED TEE SECTIONS

[75] Inventor: Roger C. DeBloois, Westlake Village, Calif.

[73] Assignee: The United States of America as represented by the Secretary of the Army, Washington, D.C.

[21] Appl. No.: 179,309

[22] Filed: Aug. 18, 1980

[51] Int. Cl.[3] ..... H01P 1/22

[52] U.S. Cl. ..... 333/81 A; 338/217; 338/307; 338/309; 333/238

[58] Field of Search ..... 333/22 R, 81 R, 81 A; 338/217, 307, 308, 309, 320

[56] References Cited

U.S. PATENT DOCUMENTS

| | | | |
|---|---|---|---|
| 2,459,857 | 1/1949 | Watts, Jr. | 338/217 X |
| 3,260,971 | 7/1966 | Bacher et al. | 333/81 A |
| 3,585,533 | 6/1971 | Denhard | 333/22 R |
| 3,678,417 | 7/1972 | Ragan et al. | 333/22 R |
| 3,740,676 | 6/1973 | Garuts | 333/81 A |

*Primary Examiner*—Paul L. Gensler

*Attorney, Agent, or Firm*—Nathan Edelberg; Sheldon Kanars; Jeremiah G. Murray

[57] ABSTRACT

An attenuator and termination having a relatively flat frequency response for attenuating and dissipating electrical energy is comprised of a plurality of cascaded tee attenuator sections formed on a substantially flat surface ceramic substrate comprised of alumina, for example. The attenuator sections are configured from a single thin film series resistor comprised of gold and a plurality of shunt resistors formed from a layer of cermet which underlies the gold film resistor. The cermet shunt resistors extend away from the series resistor to the side edge of the substrate where they terminate in a ground contact configuration which wraps around the side and lower surface of the substrate.

11 Claims, 4 Drawing Figures

FIG.1
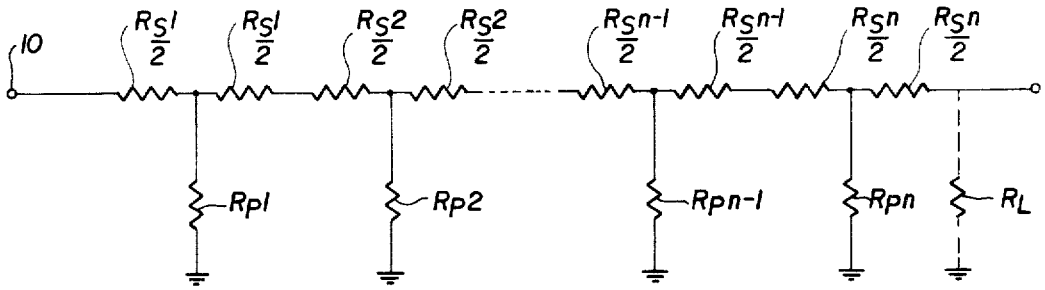
FIG.2
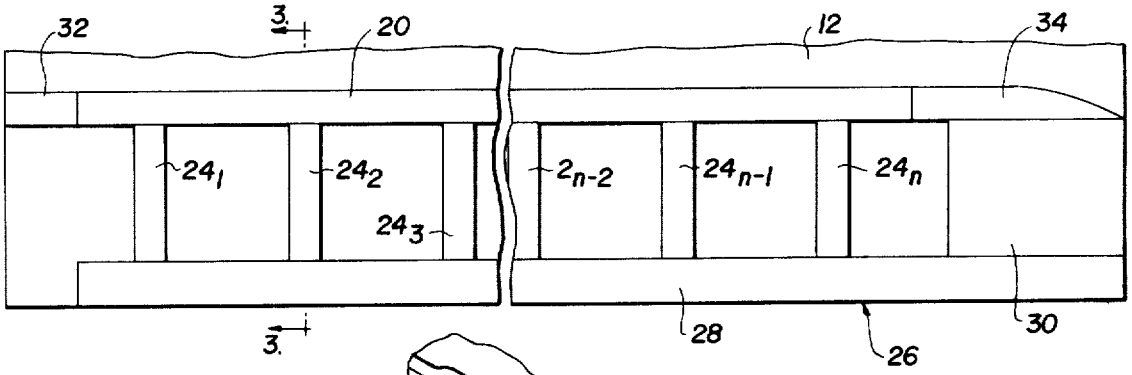
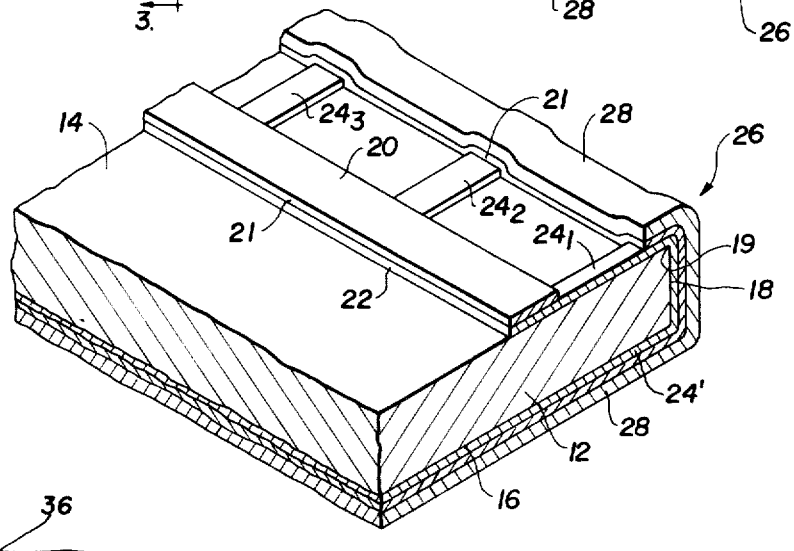
FIG.3
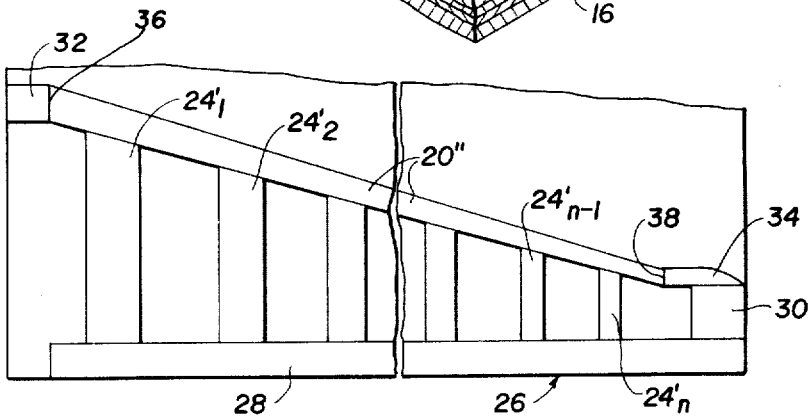
FIG.4

HIGH POWER ATTENUATOR AND TERMINATION HAVING A PLURALITY OF CASCADED TEE SECTIONS

The invention described herein may be manufactured and used by or for the Government for governmental purposes without the payment of any royalties thereon or therefor.

BACKGROUND OF THE INVENTION

This invention relates generally to resistance attenuators of wide band frequency response and more particularly to a high power attenuator and termination constructed in the form of a microstrip transmission line.

In the past high power terminations have been made from a large block of dissipative or resistive material. The size of the block material determines the power dissipation capability of the load. The use of such devices, however, has been limited to either relatively narrow frequency ranges where the parasitic reactances can be tuned out or over larger frequency ranges at reduced accuracy. More recently, a resistance attenuator in which a lossy transmission line is employed to form a distributed resistor from which a plurality of separate shunt resistors of equal value extend therefrom has been shown and described in U.S. Pat. No. 3,740,676, entitled, "Continuously Variable Resistance Attenuator Using Lossy Transmission Line And Having Constant Signal Transit Time" issued to V. E. Garuts on June 19, 1973. It is to this latter type of device to which the subject invention is directed.

SUMMARY

It is an object of the present invention, therefore, to provide an improved means of attenuating and dissipating electrical energy over a wide frequency band.

It is another object of the present invention to provide a microstrip type of attenuator and termination which is particularly adapted for use at microwave frequencies.

These and other objects are provided by a ceramic substrate consisting of, for example, alumina having an upper surface upon which is formed a layer of cermet which extends around one side to the undersurface. The cermet layer is made to define a length of material of substantially constant width which runs substantially parallel to the side edge from which a plurality of parallely spaced resistive strips extend to said edge. A thin film of metallization e.g. gold is formed over the cermet layer and made to define a strip of gold metallization on top of the length of cermet running parallel to said edge which acts as a series resistor for a plurality of cascaded tee sections which include the parallel cermet strips which extend to the edge of the substrate. A ground plane is also included and overlies the cermet layer at said edge to terminate the parallel resistive strips in a ground contact and which also extends to the substrate undersurface. One end of the strip of metallization connects to an input contact while the opposite end connects to a load contact. A load, when desirable, can be formed directly on the surface of the substrate adjacent the microstrip tee sections.

BRIEF DESCRIPTION OF THE DRAWINGS

FIG. 1 is a schematic diagram generally illustrative of the subject invention;

FIG. 2 is a plan view of a first embodiment of the subject invention;

FIG. 3 is a cross sectional view of the embodiment shown in FIG. 2 taken along the lines 3—3; and FIG. 4 is a plan view of a second embodiment of the subject invention.

DESCRIPTION OF THE PREFERRED EMBODIMENT

Instead of using a large block of dissipative material for implementing a high power attenuator and termination for electrical energy, the present invention provides a plurality of small attenuator sections which are cascaded, with each section dissipating a small amount of the applied power and transmitting the remaining power to the next section where another small amount of the remaining power is dissipated. This process is continued until the desired attenuation has been achieved or until the remaining power is small enough to be easily dissipated in a suitable load. Because each section can be made physically small, the parasitics, which limit the usefulness of the older block type dissipator, can be maintained at exactly low levels thereby extending the useful frequency of the device. If each section of the attenuator is allowed to become infinitesimally small, the entire dissipator becomes a classic example of a transmission line having a ratio of series resistance per unit length to the induction per unit length which is equal to the ratio of shunt conductance per unit length to the capacitance per unit length, or $R/L=G/C$. Such a transmission line exhibits no frequency effects and therefore has a useful range from zero (DC) to infinite frequency with equal accuracy at all frequencies.

Referring now to the drawings and more particularly to FIG. 1, the present invention schematically is illustrated therein as a plurality of cascaded tee attenuator sections consisting of a set of series resistors $$\frac{R_s1}{2}, \frac{R_s1}{2}, \frac{R_s2}{2}, \frac{R_s2}{2}, \ldots \frac{R_sn}{2}, \frac{R_sn}{2}$$

and a plurality of intermediate shunt resistors $R_P1 \ldots R_Pn$. The first series resistor is adapted to be connected to an electrical contact, whereas the last series resistor is connected to a shunt load resistor $R_L$.

Regarding the preferred physical implementations of the subject invention, FIGS. 2 and 3 disclose a microstrip structure wherein reference numeral 12 designates a ceramic substrate consisting of, for example, alumina which is configured to have substantially flat top and bottom surfaces 14 and 16 as well as adjoining side surface 18. On the upper surface 14 of the substrate 12, an elongated thin film series resistor 20 formed from a thin layer 21 of gold is adapted to implement the resistors $$\frac{R_s1}{2} \ldots \frac{R_sn}{2}$$

and overlays a like elongated portion 22 of cermet from which a plurality of orthogonal parallel resistive strip segments $24_1 \ldots 24_n$ extend toward the edge 19 to implement the shunt resistors $R_P1 \ldots R_Pn$. The resistive segments $24_1 \ldots 24_n$ of cermet are adapted to terminate in a ground plane 26 which extends from the top surface 14 of the substrate near the edge 19 around the side surface 18 and over the undersurface 16. The ground plane 26 consists of the outer portion of the thin gold layer 21 and a relatively thick outer gold ground contact layer 28. As shown in FIG. 3, the cermet shunt resistor segments $24_1$, $24_2$ and $24_3$ extend into the layer 24' and lie beneath the gold layers 21 and 28. It also wraps around the side 18 of the alumina substrate from the top surface 14 to the under-surface 16.

This configuration results from a fabrication process wherein a cermet layer 24 is first sputtered on all the outer surfaces of the substrate 12 followed by a sputtering of a thin film 21 of gold. A photoresist layer is next applied and the relatively thick ground contact layer 28 is plated up along with input and load contact regions 32 and 34 (FIG. 2) over the gold layer 21. The photoresist is removed and another photoresist layer is applied defining the gold strip 20 whereupon an etching step next removes all the exposed thin layer of gold with the exception of strip 20. Next a photoresist layer defining the shunt segments $24_1 \ldots 24_n$ and when desirable, a load segment 30 is applied after which the remainder of the cermet is etched off. The photoresist protecting the cermet areas defining the shunt segments $24_1 \ldots 24_n$ and load 30 is next removed. Lastly the resistance(s) is adjusted by a slow etching of the cermet shunt segments $24_1 \ldots 24_n$ and/or gold strip 20.

What is significant, however, is that the thin film gold strip 20 and the orthogonal cermet segments $24_1 \ldots 24_n$ define cascaded tee sections 1 . . . n of the circuit shown in FIG. 1. By controlling the relationship between resistivity of the series and shunt segments, the frequency effects are effectively reduced if not eliminated. For a configuration wherein a characteristic impedance of 50 ohms is desired, the thin film gold transmission line 20 which implements the series resistors $R_s1$, etc. typically has a resistivity of 1 ohm per square. The shunt resistors provided by the cermet segments $24_1 \ldots 24_n$ on the other hand, typically have a resistivity of 160 ohms per square.

As noted above, when desirable the load resistor $R_L$ is implemented directly on the substrate by means of the cermet segment 30 which also has a resistivity of 160 ohms per square. The combination of these values results in a lossy frequency flat transmission line terminated with a load resistance equal to the characteristic impedance of the line. The load resistor $R_L$ may also take the form of a plated gold transmission line similar to the strip resistor 20.

Although alumina has thus far been described as the desired material for the substrate 12, other substrates may be used for the power capability of the device, for example, the use of berrylium oxide for the substrate material would act to increase the power capability of the device substantially. Also, when desirable, other metal systems apart from gold and cermet may be employed.

For the configuration shown in FIGS. 2 and 3, while it lends itself to a relatively simplified structure in that the width of the series strip resistor 20 is of consistent width throughout its length and is substantially equal to the width of the shunt segments 24, such an arrangement does not result in an equal power distribution throughout the plurality of cascaded tee sections. Should an equal power distribution or dissipation be desired, an embodiment such as shown in FIG. 4 would be resorted to. In such a design, the length of gold metallization 20'' forming the series resistors $$\frac{R_s1}{2} \cdots \frac{R_sn}{2}$$

would be tapered downward from the input end 36 to the load end 38. Additionally, the cermet shunt resistor segments $24'_1 \ldots 24'_n$ would not be equally spaced as in the first embodiment described herein, but rather are spaced relatively closer together as the load end 38 is approached. Also their width and length decrease as well.

Thus what has been shown and described is a high power attenuator and termination device which provides a relatively precise method of attenuating and dissipating electrical energy from essentially DC up through microwave frequencies. Additionally, the use of thin film techniques herein described allow large amounts of input power to be accommodated without introducing parasitics which ultimately limit the useful frequency range of such a device.

Having thus shown and described what is at present to be considered the preferred embodiments, it should be noted that this disclosure has been made by way of illustration and not of limitation and accordingly the scope of the present invention is defined in the appended claims forming a part of this specification.

What is claimed is:

1. A microstrip power attenuator having a relatively flat frequency response adapted to be coupled to a load impedance, comprising, in combination:

a ceramic substrate having top, bottom and adjoining side surfaces;

a layer of cermet formed on said top, bottom and side surfaces, said layer on said top surface being configured to provide a predetermined length of cermet of selected width extending across said top surface in a substantially linear configuration and having a plurality of spaced lengths of cermet projecting outwardly from said linear configuration towards said side surface and terminating in said cermet layer extending therefrom around said side surface to and over a predetermined portion of said bottom surface;

a layer of metallization formed over said layer of cermet and being configured to at least overlay said linear configuration of cermet;

a metallized ground plane formed on said top surface to contact said spaced lengths of cermet and extending around said side surface to and over a predetermined portion of said bottom surface;

said layer of metallization and said spaced lengths of cermet thereby defining a plurality of cascaded tee sections;

first metallization contact means formed on said top surface extending to one end of said layer of metallization for coupling electrical power thereto; and second metallization contact means formed on said top surface extending to the opposite end of said layer of metallization for coupling to said load impedance.

2. The microstrip power attenuator as defined by claim 1 wherein said length of metallization is of a uniform width and said spaced lengths of cermet are also of a uniform width and substantially equally spaced from one another.

3. The attenuator as defined by claim 2 wherein said load impedance is formed on said top surface of said substrate adjacent the last of said plurality of cascaded tee sections.

4. The attenuator as defined by claim 3 wherein said load impedance comprises a portion of said layer of cermet formed on said top surface of said substrate.

5. The attenuator as defined by claim 1 wherein said metallized ground plane comprises a relatively thin first layer of metallization equal to thickness to said layer of metallization formed over said layer of cermet and a second layer of metallization having a thickness substantially greater than said first layer formed over side layer of cermet.

6. The attenuator as defined by claim 1 wherein said layer of metallization formed over said layer of cermet comprises gold having a resistivity of substantially 1.0 ohms per square.

7. The attenuator as defined by claim 6 wherein said layer of cermet has a resistivity of substantially 160 ohms per square whereby the combination of the resistivity of said gold metallization and said cermet provide a characteristic impedance of 50 ohms.

8. The attenuator as defined by claim 1 wherein said linear configuration of said layer of metallization consists of a length of metallization which is tapered in width from said first metallization contact means to said second metallization contact means.

9. The attenuator as defined by claim 8 wherein said length of metallization is uniformly tapered and wherein said spaced lengths of cermet have an unequal spacing, length and width, which gradually decreases as said taper decreases toward said second contact means.

10. The attenuator as defined by claim 9 wherein said load impedance is formed on said top surface of said substrate.

11. The attenuator as defined by claim 10 wherein said load impedance comprises a portion of said layer of cermet formed on said top surface.

* * * * *